US009238266B2

(12) United States Patent
Waniuk et al.

(10) Patent No.: US 9,238,266 B2
(45) Date of Patent: Jan. 19, 2016

(54) COLD CHAMBER DIE CASTING WITH MELT CRUCIBLE UNDER VACUUM ENVIRONMENT

(71) Applicant: Apple Inc., Cupertino, CA (US)

(72) Inventors: Theodore A. Waniuk, Lake Forest, CA (US); Joseph Stevick, Olympia, WA (US); Sean O'Keeffe, Tustin, CA (US); Dermot J. Stratton, San Francisco, CA (US); Joseph C. Poole, San Francisco, CA (US); Matthew S. Scott, San Jose, CA (US); Christopher D. Prest, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/481,271

(22) Filed: Sep. 9, 2014

(65) Prior Publication Data

US 2015/0090421 A1 Apr. 2, 2015

Related U.S. Application Data

(62) Division of application No. 13/628,267, filed on Sep. 27, 2012, now Pat. No. 8,826,968.

(51) Int. Cl.
*B22D 17/10* (2006.01)
*B22D 17/14* (2006.01)
(Continued)

(52) U.S. Cl.
CPC ..... *B22D 25/06* (2013.01); *B22D 1/002* (2013.01); *B22D 17/10* (2013.01); *B22D 17/14* (2013.01);
(Continued)

(58) Field of Classification Search
CPC ..... B22D 17/10; B22D 17/14; B29C 45/34; B29C 45/63
USPC ..... 164/61–68.1, 113, 253–258, 303, 305, 164/312
See application file for complete search history.

(56) References Cited

U.S. PATENT DOCUMENTS 3,671,029 A 6/1972 Kurlsson
3,731,727 A 5/1973 Mitamura et al.
(Continued)

FOREIGN PATENT DOCUMENTS

DE 19902002 7/2000
EP 0845316 6/1998
(Continued)

OTHER PUBLICATIONS

Inoue et al., "Bulk amorphous alloys with high mechanical strength and good soft magnetic properties in Fe—Tm—B(TM=IV-VIII group transition metal) system", Appl. Phys. Lett., vol. 710, p. 464 (1997).
(Continued)

*Primary Examiner* — Kevin E Yoon
(74) *Attorney, Agent, or Firm* — Brownstein Hyatt Farber Schreck, LLP

(57) ABSTRACT

Exemplary embodiments described herein related to methods and systems for casting metal alloys into articles such as BMG articles. In one embodiment, processes involved for storing, pre-treating, alloying, melting, injecting, molding, etc. can be combined as desired and conducted in different chambers. During these processes, each chamber can be independently, separately controlled to have desired chamber environment, e.g., under vacuum, in an inert gas environment, or open to the surrounding environment. Due to the flexible, independent control of each chamber, the casting cycle time can be reduced and the production throughput can be increased. Contaminations of the molten materials and thus the final products are reduced or eliminated.

20 Claims, 5 Drawing Sheets

(51) Int. Cl.

| | |
|---|---|
| ***B22D 25/06*** | (2006.01) |
| ***B22D 27/15*** | (2006.01) |
| ***B22D 41/02*** | (2006.01) |
| ***B22D 41/08*** | (2006.01) |
| ***B22D 41/16*** | (2006.01) |
| ***B22D 1/00*** | (2006.01) |
| ***B22D 17/20*** | (2006.01) |
| ***B22D 35/04*** | (2006.01) |
| ***B22D 41/00*** | (2006.01) |

(52) U.S. Cl.

CPC ..... *B22D 17/20* (2013.01); *B22D 27/15* (2013.01); *B22D 35/04* (2013.01); *B22D 41/00* (2013.01); *B22D 41/02* (2013.01); *B22D 41/08* (2013.01); *B22D 41/16* (2013.01)

(56) References Cited

U.S. PATENT DOCUMENTS

| | | | |
|---|---|---|---|
| 4,040,845 | A | 8/1977 | Richerson et al. |
| 4,135,568 | A | 1/1979 | Brooks |
| 4,265,294 | A | 5/1981 | Gaule |
| 4,550,412 | A | 10/1985 | Holcombe et al. |
| 4,612,973 | A | 9/1986 | Whang |
| 4,678,024 | A | 7/1987 | Hull |
| 4,693,299 | A | 9/1987 | Kuznetsov et al. |
| 4,799,532 | A | 1/1989 | Mizuhara |
| 4,887,798 | A | 12/1989 | Julius |
| 5,003,551 | A | 3/1991 | Mortimer |
| 5,087,804 | A | 2/1992 | McGaffigne |
| 5,288,344 | A | 2/1994 | Peker et al. |
| 5,368,659 | A | 11/1994 | Peker et al. |
| 5,487,421 | A | 1/1996 | Gerber |
| 5,616,024 | A | 4/1997 | Nobori |
| 5,618,359 | A | 4/1997 | Lin et al. |
| 5,711,363 | A | 1/1998 | Scruggs et al. |
| 5,735,975 | A | 4/1998 | Lin et al. |
| 5,860,468 | A | 1/1999 | Cook |
| 5,896,642 | A | 4/1999 | Peker et al. |
| 5,976,247 | A | 11/1999 | Hansen et al. |
| 6,021,840 | A | 2/2000 | Colvin |
| 6,070,643 | A | 6/2000 | Colvin |
| 6,189,600 | B1 | 2/2001 | Taniguchi et al. |
| 6,267,170 | B1 | 7/2001 | Onuki et al. |
| 6,267,171 | B1 | 7/2001 | Onuki et al. |
| 6,283,197 | B1 | 9/2001 | Kono |
| 6,325,868 | B1 | 12/2001 | Kim et al. |
| 6,371,195 | B1 | 4/2002 | Onuki et al. |
| 6,427,753 | B1 | 8/2002 | Inoue et al. |
| 6,805,189 | B2 | 10/2004 | Ervin |
| 6,875,293 | B2 | 4/2005 | Peker |
| 7,017,645 | B2 | 3/2006 | Johnson et al. |
| 7,235,910 | B2 | 6/2007 | Decristofaro et al. |
| 7,377,303 | B2 | 5/2008 | Go |
| 7,488,170 | B2 | 2/2009 | Yuasa et al. |
| 7,575,040 | B2 | 8/2009 | Johnson |
| 7,708,844 | B2 | 5/2010 | Muramatsu et al. |
| 7,906,219 | B2 | 3/2011 | Ohara et al. |
| 2002/0005233 | A1 | 1/2002 | Schirra et al. |
| 2005/0028961 | A1 | 2/2005 | Toyoshima et al. |
| 2005/0242454 | A1 | 11/2005 | Yuasa et al. |
| 2006/0042773 | A1 | 3/2006 | Eisen |
| 2006/0254747 | A1 | 11/2006 | Ishida et al. |
| 2007/0079907 | A1 | 4/2007 | Johnson et al. |
| 2008/0118387 | A1 | 5/2008 | Demetriou et al. |
| 2008/0135136 | A1 | 6/2008 | Demetriou et al. |
| 2009/0162629 | A1 | 6/2009 | Demetriou et al. |
| 2009/0236494 | A1 | 9/2009 | Hata et al. |
| 2009/0321037 | A1 | 12/2009 | Lewis et al. |
| 2010/0084052 | A1 | 4/2010 | Farmer et al. |
| 2010/0098967 | A1 | 4/2010 | Schroers |
| 2010/0230012 | A1 | 9/2010 | Demetriou et al. |
| 2010/0300148 | A1 | 12/2010 | Demetriou et al. |
| 2011/0011750 | A1 | 1/2011 | Lovens |
| 2011/0079940 | A1 | 4/2011 | Schroers et al. |
| 2011/0108231 | A1 | 5/2011 | Zheng et al. |
| 2012/0211193 | A1 * | 8/2012 | Bochiechio et al. ..... 164/512 |

FOREIGN PATENT DOCUMENTS

| | | |
|---|---|---|
| EP | 1013363 | 6/2000 |
| EP | 1415740 | 5/2004 |
| FR | 2665654 | 2/1992 |
| GB | 392764 | 5/1933 |
| GB | 574914 | 1/1946 |
| GB | 784363 | 10/1957 |
| JP | 55036033 | 3/1980 |
| JP | 6212205 | 8/1994 |
| JP | 8013111 | 1/1996 |
| JP | 1994212205 | 3/1996 |
| JP | 9272929 | 10/1997 |
| JP | 1997272929 | 4/1999 |
| JP | 2000024767 | 1/2000 |
| JP | 2000326065 | 11/2000 |
| JP | 2001071113 | 3/2001 |
| JP | 2001259821 | 9/2001 |
| JP | 2001303218 | 10/2001 |
| JP | 2004050269 | 2/2004 |
| JP | 2006289466 | 10/2006 |
| JP | 2009068101 | 4/2009 |
| JP | 2009172627 | 8/2009 |
| JP | 2009173964 | 8/2009 |
| JP | 2010036210 | 2/2010 |
| WO | WO0037201 | 6/2000 |
| WO | WO0240727 | 5/2002 |
| WO | WO2005004559 | 1/2005 |
| WO | WO2006127792 | 11/2006 |
| WO | WO2008046219 | 4/2008 |
| WO | WO2009067512 | 5/2009 |
| WO | WO2010108744 | 9/2010 |
| WO | WO2010111701 | 9/2010 |

OTHER PUBLICATIONS

Shen et al., 01., "Bulk Glassy Co43Fe20Ta5.5B31.5 Alloy with High Glass-Forming Ability and Good Soft Magnetic Properties", Materials Transactions, vol. 42 No. 10 (2001) pp. 2136-2139.

International Search Report issued in PCT/US2011/052354, mailed Mar. 16, 2012.

International Search Report issued in PCT/US2011/054153, mailed Jun. 13, 2012.

Wolf, S.; R.N. Tauber (1986),Silicon Processing for the VLSI Era: vol. 1—Process Technology. Lattice Press. pp. 531-534, 546.

Walker, Perrin; William H. Tarn (1991), CRC Handbook of Metal Etchants. pp. 287-291.

Kohler, Michael (1999). Etching in Microsystem Technology. John Wiley & Son Ltd. p. 329.

McDeavitt et al., "High Temperature Interaction Behavior at Liquid Metal-Ceramic Interfaces", Journal of Materials Engineering and Performance, vol. 11, Aug. 2002.

Kargahi et al., "Analysis of failure of conducting crucible used in induction metal", Aug. 1988.

Inoue et al., "Microstructure and Properties of Bulky Al84Ni10Ce6 Alloys with Amorphous Surface Layer Prepared by High-Pressure Die Casting", Materials Transactions, JIM, vol. 35, No. 11 (1994), pp. 808-813.

Larsen et al., "Vacuum-Die Casting Titanium for Aerospace and Commercial Components", JOM, Jun. 1999, pp. 26-27.

* cited by examiner

COLD CHAMBER DIE CASTING WITH MELT CRUCIBLE UNDER VACUUM ENVIRONMENT

RELATED APPLICATIONS

The current application is a divisional of U.S. patent application Ser. No. 13/628,267, filed Sep. 27, 2012, which will issue as U.S. Pat. No. 8,826,968 on Sep. 9, 2014, the disclosure of the prior application is considered part of and is incorporated by reference in the disclosure of this application.

FIELD OF THE INVENTION

The present embodiments relate to devices and systems for casting metal alloys. The present embodiments also relate to methods of making and using the same.

BACKGROUND

In injection molding, a melt crucible is often coupled with a cast machine in a vacuum environment to transfer molten material from the melt crucible into the cast machine. Often, there is leakage during this transfer and this leakage may contaminate molten material and/or the melt crucible. In addition, the melt crucible and the cast machine are configured contiguous in the same environment for both the melting and casting processes, which, however, requires long cycle time. Further, the molten material at high temperature may be in contact with the melt crucible for a sufficient long time to physically and/or chemically react with each other, i.e., to contaminate the molten material and/or surfaces of the melt crucible. Furthermore, in many cases, there are times that one does not want to have same one environment such as vacuum for the entire process.

SUMMARY

Exemplary embodiments described herein relate to methods and systems for casting metal alloys into articles such as BMG articles. In one embodiment, processes involved for storing, pre-treating, alloying, melting, injecting, molding, etc. can be combined as desired and conducted in different chambers. During these processes, each chamber can be independently, separately controlled to have desired chamber environment. The chamber environment may be controlled to be, e.g., under vacuum, in an inert gas environment, or open to the surrounding environment. Due to this flexible, independent control of each chamber, the casting cycle time can be reduced and the production throughput can be increased. Contaminations of the molten materials can be reduced or eliminated. Clean products can be formed. For example, because molten materials now have a reduced contact time with melt vessels, contaminations between the molten materials and the vessel surface can be reduced or eliminated. In addition, various processes can be combined in one system and materials may have less exposure to air or oxygen, the oxygen level in the final products can be reduced.

The disclosed systems and methods provide flexibilities on operations. In the case when vacuum is not favorable for all related chambers, e.g., in certain cases, it may be desirable to melt materials in positive pressure and to cast molten materials in vacuum, or vice versa, each of the above mentioned chambers can be independently controlled to have desired chamber environment for specific process. In another example, vacuum seal on the mold may not be good enough for processes under vacuum, related chamber environment can be controlled to be under pressure, e.g., using inert gases, followed by pulling mechanical vacuum during ejection, or vice versa. In yet another example, metal alloys may be melted under high pressure argon to suppress evaporation or the like.

In accordance with various embodiments, there is provided a casting system. The casting system can include a first chamber having at least one vessel configured to contain a molten material. The casting system also can include a transfer zone chamber containing at least a portion of the first chamber and at least a portion of a casting machine to transfer the molten material from the first chamber into the casting machine. The first chamber is configured to be capable of controlling a chamber environment independently from the transfer zone chamber. The casting system could further comprise a second chamber connected to the first chamber configured to provide a material for forming the molten material in the first chamber.

Optionally, at least one vessel in the first chamber is a melt vessel for melting materials therein to form the molten material. Optionally, at least one vessel in the first chamber comprises a skull melter. Optionally, at least one vessel in the first chamber is an alloying chamber for forming a metal alloy from an alloy constituent comprising at least one metal. Optionally, at least one vessel in the first chamber is configured to tilt pour or bottom pour the molten material therefrom. Optionally, the first chamber is decoupled from the transfer zone chamber. Optionally, the first chamber comprises a gate valve configured to open the first chamber to allow the molten material to enter at least one portion of the casting machine. Optionally, the first chamber is configured inside or outside the transfer zone chamber. Optionally, each of the first chamber and the transfer zone chamber is connected to a source device to independently control a corresponding chamber environment. Optionally, the casting machine comprises a die casting machine. Optionally, at least a portion of the casting machine comprises one or more of a transfer sleeve, an injection device, a mold cavity, and a combination thereof. Optionally, the casting machine is one of a plurality of casting machines. Optionally, the casting machine comprises a plurality of mold cavities in the same casting machine. Optionally, the second chamber is a charge zone chamber configured to store one or more charges of a metal alloy for forming the molten material. Optionally, the second chamber is a charge zone chamber configured to preheat one or more charges of a metal alloy. Optionally, the second chamber is a storage chamber for storing an alloy constituent. Optionally, the second chamber is configured inside or outside the first chamber. Optionally, each of the first chamber, the second chamber, and the transfer zone chamber is connected to a source device to independently control a corresponding chamber environment. Optionally, the second chamber comprises at least one vessel. Optionally, each of the first chamber and the transfer zone environment is independently adjusted to be under vacuum, in an inert environment, or open to a surrounding environment.

In accordance with various embodiments, there is provided a method of forming a casting system. To form such a system, a first chamber can be provided to have at least one vessel to contain a molten material. A casting machine can also be provided to cast the molten material. A transfer zone chamber can then be formed to include at least a portion of the first chamber and at least a portion of the casting machine to transfer the molten material from the first chamber into the casting machine. The first chamber can be configured to be capable of controlling a chamber environment independently from the transfer zone chamber. The method could further comprise adjusting a transfer zone environment of the transfer zone chamber prior to transferring the molten material.

In accordance with various embodiments, there is provided a method of forming a casting system. To form such a system, a first chamber can be provided to have at least one vessel to contain a molten material. A second chamber can be connected to the first chamber to provide a material for forming the molten material. A transfer zone chamber can then be formed to include at least a portion of the first chamber and at least a portion of a casting machine to transfer the molten material from the first chamber into the casting machine. The first chamber can be configured to be capable of controlling a chamber environment independently from the transfer zone chamber.

In accordance with various embodiments, there is provided a casting method. In this method, a casting system can be obtained to include a transfer zone chamber. The transfer zone chamber can include at least a portion of a first chamber and at least a portion of the casting machine. The first chamber can include at least one vessel configured to contain a molten material for casting in the casting machine. After obtaining the casting system, a chamber environment of the first chamber can be adjusted and the molten material can be formed in the at least one vessel of the first chamber. The molten material can then be transferred in the transfer zone chamber from the first chamber into the casting machine for casting the molten material into products. While transferring the molten material, the chamber environment of the first chamber can be substantially independently maintained.

In accordance with various embodiments, there is provided a casting method. In this method, a casting system can be obtained to include a transfer zone chamber. The transfer zone chamber can include at least a portion of a first chamber and at least a portion of the casting machine. The first chamber can include at least one vessel configured to contain a molten material for casting in the casting machine. The first chamber can be connected to a second chamber. After obtaining the casting system, a chamber environment of the first chamber can be adjusted independently from a transfer zone environment of the transfer zone chamber. A feedstock of a metal alloy can be transferred from the second chamber into the first chamber to form the molten material in the at least one vessel of the first chamber by melting the transferred feedstock. The molten material can then be transferred, in the transfer zone environment, from the first chamber into the at least one portion of the casting machine for casting the molten material into products. While transferring the molten material, the chamber environment of the first chamber can be substantially independently maintained.

In accordance with various embodiments, there is provided a casting method. In this method, a casting system can be obtained to include a transfer zone chamber. The transfer zone chamber can include at least a portion of a first chamber and at least a portion of the casting machine. The first chamber can include at least one vessel configured to contain a molten material for casting in the casting machine. The first chamber can be connected to a second chamber. After obtaining the casting system, a chamber environment of the first chamber can be adjusted independently from a transfer zone environment of the transfer zone chamber. An alloy constituent can be provided in the second chamber having a second chamber environment and transferred from the second chamber into the first chamber to form the molten material in the at least one vessel of the first chamber by alloying the alloy constituent and melting the alloyed metal alloy. The molten material can then be transferred, in the transfer zone environment, from the first chamber into the at least one portion of the casting machine for casting into products. While transferring the molten material, the chamber environment of the first chamber can be substantially independently maintained.

The method could further comprise substantially independently maintaining a transfer zone environment while transferring the molten material. The method could further comprise substantially independently maintaining the first chamber in an inert environment, while the transfer zone chamber is substantially independently maintained under vacuum. The method could further comprise substantially independently maintaining the first chamber in an inert environment or under vacuum, while the transfer zone chamber is open to a surrounding environment. The method could further comprise controlling the transfer zone chamber under a vacuum higher than a vacuum in the first chamber. The method could further comprise casting the molten material in the casting machine, wherein the casting machine comprises a die casting machine. The method could further comprise casting the molten material into BMG parts, wherein the BMG parts is formed of a Zr-based, Fe-based, Ti-based, Pt-based, Pd-based, gold-based, silver-based, copper-based, Ni-based, Al-based, Mo-based, Co-based alloy, or combinations thereof. The method could further comprise independently controlling an environment containing portions of the casting machine other than the at least one portion thereof in the transfer zone chamber, and a chamber environment of each of the first chamber, the second chamber, and/or the transfer zone chamber. The method could further comprise adjusting the transfer zone environment prior to transferring the molten material; and substantially independently maintaining the transfer zone environment while transferring the molten material.

Optionally, the second chamber has a second chamber environment and wherein the first and the second chamber environments are independently controlled to be the same or different. Optionally, transferring the feedstock of the metal alloy from the second chamber comprises preheating the feedstock in a second chamber environment prior to transferring, wherein the preheated feedstock is maintained non-molten in the second chamber. Optionally, melting the transferred feedstock comprises an induction skull remelting or melting, a vacuum induction melting (VIM), an electron beam melting, a resistance melting, or a plasma arc melting. Optionally, melting the transferred feedstock comprises melting under an inert gas environment.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
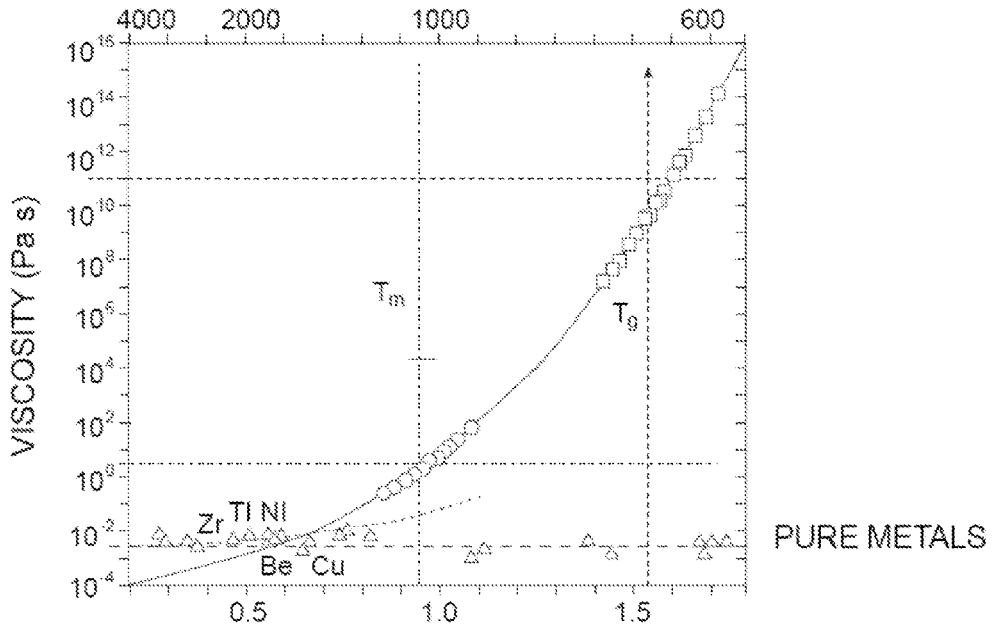
Figure 1 PRIOR ART
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
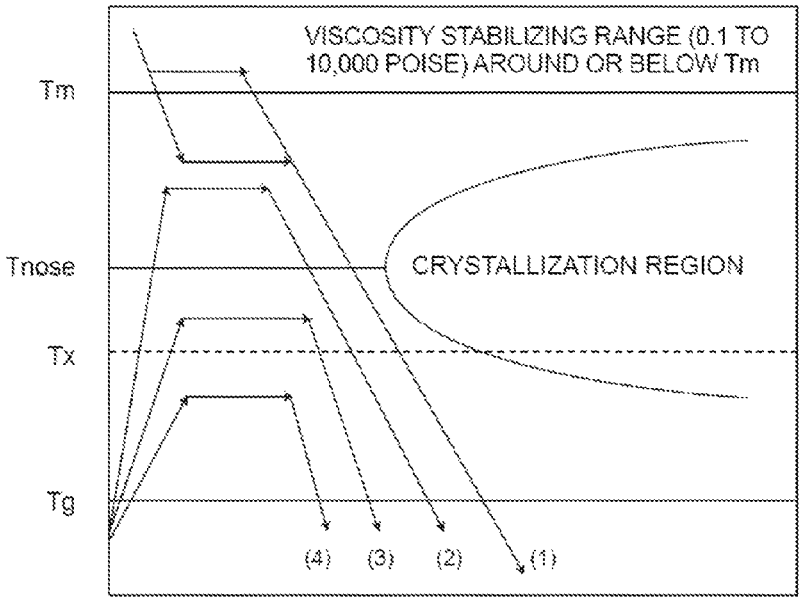
Figure 2 PRIOR ART
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between 1012 Pa s at the glass transition temperature down to 105 Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x, x')=\langle s(x), s(x')\rangle$ .

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula (Zr, Ti)a(Ni, Cu, Fe)b(Be, Al, Si, B)c, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula (Zr, Ti)a(Ni, Cu)b(Be)c, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula (Zr, Ti)a(Ni, Cu)b(Be)c, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula (Zr)a(Nb, Ti)b(Ni, Cu)c(Al)d, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the afore-described alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |

TABLE 2-continued

Additional Exemplary amorphous alloy compositions (atomic %)

| Alloy | Atm % | Atm % | Atm % | Atm % | Atm % | Atm % |
|---|---|---|---|---|---|---|
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)—C—B, Co—Cr—Mo—Ln—C—B, Fe—Mn—Cr—Mo—(Y,Ln)—C—B, (Fe, Cr, Co)—(Mo, Mn)—(C,B)—Y, Fe—(Co,Ni)—(Zr,Nb,Ta)—(Mo,W)—B, Fe—(Al,Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions Fe80P12.5C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is Fe72Al5Ga2P11C6B4. Another example is Fe72Al7Zr10Mo5W2B15. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The amorphous alloy can also be one of the Pt- or Pd-based alloys described by U.S. Patent Application Publication Nos. 2008/0135136, 2009/0162629, and 2010/0230012. Exemplary compositions include Pd44.48Cu32.35Co4.05P19.11, Pd77.5Ag6Si9P7.5, and Pt74.7Cu1.5Ag0.3P18B4Si1.5.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature Tx. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

The embodiments described herein relate to systems for casting and methods of making and using the casting systems. As used herein, the term "casting" refers to a process of molding or forming wherein impressions are made with molten materials as by pouring or transferring into a mold or onto a sheet, followed by solidifying the molten material in the mold or on the sheet.

In an embodiment, the melt crucible and all heated alloy feedstock held under vacuum. The proposed embodiment keeps the melt crucible protected in a small evacuated chamber behind a gate valve, which opens and allows the molten metal to enter the cold sleeve chamber to pour only when it has been evacuated sufficiently. The embodiment also assumes mold tooling that is capable of holding medium to high vacuum as well, as the cavity can be considered part of the cold sleeve/pour chamber. An advantage of the embodiment is that the melt zone chamber is decoupling from the cast zone chamber thereby the melt zone chamber can maintained under vacuum even when the cast zone chamber has been opened.

In one embodiment, the casting system can include a first chamber having at least one vessel configured to contain a molten material. The casting system also includes a transfer zone chamber containing at least a portion of the first chamber and at least a portion of a casting machine configured to transfer the molten material from the first chamber into the casting machine. The first chamber having at least one vessel configured to contain a molten material is capable of controlling a chamber environment independently from the transfer zone chamber.

In embodiments, the at least one vessel may be a container in a form of, for example, a boat, a cup, a crucible, etc. The vessels may have any desirable geometry with any shape or size. For example, it may be cylindrical, spherical, cubic, rectangular, and/or an irregular shape.

The vessels may be formed of a ceramic, a graphite, etc. Exemplary ceramic may include at least one element selected from Groups IVA, VA, and VIA in the Periodic Table. The ceramic may include a thermal shock resistant ceramic or other ceramics. Specifically, the element can be at least one of Ti, Zr, Hf, Th, Va, Nb, Ta, Pa, Cr, Mo, W, and U. In one embodiment, the ceramic may include an oxide, nitride, oxynitride, boride, carbide, carbonitride, silicate, titanate, silicide, or combinations thereof. For example, the ceramic can include, silicon nitride, silicon oxynitride, silicon carbide, boron carbonitride, titanium boride ($TiB_2$), zirconium silicate (or "zircon"), aluminum titanate, boron nitride, alumina, zirconia, magnesia, silica, tungsten carbide, or combinations thereof. The ceramic may or may not include thermal shock sensitive ceramic, for example, yttria, aluminum oxynitride (or "sialon"), etc. The vessels may be formed of a material insensitive to radio frequency (RF) as in that used in induction heating. Alternatively, a material sensitive to RF can be used.

In embodiments, the vessel may be formed of a refractory material. A refractory material may include refractory metals, such as molybdenum, tungsten, tantalum, niobium, rehenium, etc. Alternatively, the refractory material may include a refractory ceramic. The ceramic may be any of the aforementioned ceramics, including silicon nitride, silicon carbide, boron nitride, boron carbide, aluminum nitride, alumina, zirconia, titanium diboride, zirconium silicate, aluminum silicate, aluminum titanate, tungsten carbide, silica, and/or fused silica. In embodiments, the vessels may be formed of any commercially available materials known in the art that are suitable for alloying and/or melting.

The vessels may have the ability to absorb electromagnetic energy and convert it to heat, which may sometimes be designed to be re-emitted as infrared thermal radiation. This energy may be radio frequency or microwave radiation used in industrial heating processes and also occasionally in microwave cooking. The vessels may be formed of silicon carbide, stainless steel, and/or any other electrically conductive materials.

In one embodiment, the inner surface of the vessel for containing molten material may be pre-treated. For example, a graphite vessel may be pre-treated with a coating of Zr or Si powder, or Zr- or Si-containing compounds that react with carbon. The vessel may then be heated under vacuum to force the powder to react with the vessel, forming zirconium or silicon carbide. The pre-treated vessel may be used to, e.g., melt alloy feedstock, minimizing carbon addition to alloy from the graphite.

In some embodiments, the at least one vessel in the first chamber can be a melt vessel for melting metal alloys. The at least one vessel in the first chamber can be a skull melter. In other embodiments, the at least one vessel in the first chamber can be an alloying chamber for forming a metal alloy from an alloy constituent including at least one metal. The formed metal alloy may then be melted in the same vessel or another vessel located in the first chamber. In embodiments, the at least one vessel in the first chamber can be configured to tilt pour, bottom pour, or otherwise transfer the molten material there-from.

The first chamber in the casting system can be decoupled from the transfer zone chamber. For example, the first chamber can be evacuated, independently from the cast machine, to protect the at least one vessel therein. In embodiments, the first chamber can include a gate valve configured to open the first chamber to allow the molten material to enter the at least one portion of the casting machine, e.g., when the casting machine is sufficiently evacuated. The first chamber can be configured inside or outside the transfer zone chamber.

As disclosed herein, each of the first chamber and the transfer zone chamber can be connected to a source device to dependently control a chamber environment of each of the first chamber and the transfer zone chamber. The source device can be a device for providing and/or controlling a chamber environment. For example, the source device can be a vacuum source device or a gas source (e.g., inert gas) device, or a device providing other components into the environment within a chamber.

In embodiments, the casting machine can be a die casting machine or any machine for casting molten materials. In one embodiment when the die casting machine is used, the transfer zone chamber may contain at least a portion of the first chamber and at least a portion of the die casting machine including, such as, for example, one or more of a transfer sleeve, an injection device, a mold cavity, and a combination thereof. In embodiments, the disclosed casting system may include a plurality of casting machines each having a portion located in the transfer zone chamber. Each casting machine can have one or more mold cavities for forming one or more final products or a final product composed of one or more different parts.

In embodiments, a second chamber may be included in the disclosed casting systems. For example, the second chamber can be connected to the first chamber to provide a material for forming the molten material in the first chamber. The second chamber can be configured inside or outside the first chamber. The second chamber can include at least one vessel. The first and second chambers (and the vessels used therein) can use the same or different configurations/materials.

In one embodiment, the second chamber can be a charge zone chamber configured to store one or more charges of a metal alloy (or feedstock of metal alloys) for forming the molten material. The metal alloy charges or the feedstock of metal alloys may be preheated in the second chamber, although in some cases, no preheating process is included. If materials are pre-heated in the second chamber, the preheated materials should be maintained non-molten and then transferred to the first chamber for melting therein. In another embodiment, the second chamber can be a storage chamber for storing an alloy constituent, which may or may not be preheated in the second chamber. The alloy constituent can then be transferred into the first chamber for alloying and melting therein to form a molten material.

In one embodiment, each of the first chamber, the second chamber, and the transfer zone chamber can be connected with individual source device to independently control a chamber environment of each of the first chamber, the second chamber, and the transfer zone chamber.

Various embodiments also include a method of forming the disclosed casting systems by forming a transfer zone chamber to include at least a portion of the first chamber and at least a portion of the casting machine to transfer the molten material from the first chamber into the casting machine. The formed casting systems may or may not include a second chamber for providing materials to the first chamber to form molten materials therein as described above. The systems may be formed to further include one or more source devices connected to the first chamber, the second chamber, and/or the transfer zone chamber to independently control a chamber environment thereof as desired. For example, the first chamber can be configured to be capable of controlling a chamber environment independently from the transfer zone chamber by using separate source devices.

Various embodiments further include a method of using the disclosed casting systems for casting molten materials to form final products. In a casting system, the chamber environment of the first chamber can be first adjusted as desired and the molten material can be formed in the at least one vessel of the first chamber. The molten material can then be transferred in the transfer zone chamber from the first chamber into the casting machine for casting into final products. The transfer zone chamber can have a desired transfer zone environment, which can be substantially independently controlled, prior to transferring the molten material. As disclosed herein, during the transfer process of the molten material or during any of the subsequent processes, the chamber environment of the first chamber and/or the transfer zone chamber can be substantially independently maintained or otherwise controlled to be, for example, under vacuum or in an inert environment or open to the surrounding environment. The chamber environments of the first chamber and the transfer zone chamber can be independently controlled to be the same or different. For example, the first chamber can be adjusted or controlled in an inert environment, while the transfer zone chamber can be adjusted or controlled under vacuum. In another example, the first chamber can be in an inert or vacuum environment, while the transfer zone chamber can be open to the surrounding environment. In yet another example, the transfer zone chamber can be independently controlled to be under a vacuum which is higher than a vacuum in the first chamber.

In embodiments, when the second chamber is included in the casting system, the chamber environment of the second chamber can be independently controlled for providing or pre-treating alloy constituents or charges (or feedstocks) of metal alloys. In embodiments, the first chamber, the second chamber, the transfer zone chamber containing at least one portion of the casting machine, and/or other portions of the casting machine can be independently controlled to have the same or different environments for forming one or more desired final products, e.g., in one casting cycle.

In various embodiments, the disclosed systems and methods may be applied to any metal alloys. For example, the metal alloys may be Zr-based, Fe-based, Ti-based, Pt-based, Pd-based, gold-based, silver-based, copper-based, Ni-based, Al-based, Mo-based, Co-based, and the like. In embodiments, BMG articles may be formed by using the disclosed systems and methods.

Melting of Metal Alloys

To form a final product such as BMG article, materials must first be melted, e.g., in a non-reactive environment, to prevent any reaction, contamination or other conditions which might detrimentally affect the quality of the resulting articles. The metal alloys may be melted in a vacuum environment or in an inert environment, e.g., argon. In some cases, gasses in the melting environment may become entrapped in the molten material and result in excess porosity in cast article, a melt chamber (or a first chamber) may be coupled to a vacuum source in which metal alloys are melted. In embodiments, single charges or multiple charges of materials at once may be melted to form molten materials, i.e., molten metal alloys.

In embodiments, the molten metal alloys may be an inductively melted metal alloy. For example, metal alloys may be melted using an induction skull remelting or melting (ISR) unit, or using other manners, such as by vacuum induction melting (VIM), electron beam melting, resistance melting or plasma arc, etc. Once one or several charges of metal alloys are melted in a vacuum environment, e.g., in a die casting process, the molten metal alloys are then transferred into a transfer (or shot) sleeve of a die casting apparatus for injection into a die cavity.

In one example, when induction skull remelting or melting (ISR) is used to melt the metal alloys, for example in a crucible vessel which is capable of rapidly, cleanly melting a single charge of material to be cast, e.g., up to about 25 pounds of material. In ISR, material is melted in the crucible vessel defined by a plurality of metal (e.g., copper) fingers retained in position next to one another. The crucible vessel is surrounded by an induction coil coupled to a power source. The fingers include passages for the circulation of cooling water from and to a water source to prevent melting of the fingers. The field generated by the coil passes through the crucible vessel, and heats and melts materials located in the crucible. The field also serves to agitate or stir the molten materials. A thin layer of the materials to be melt may freeze on the crucible wall and forms the skull, thereby minimizing the ability of molten materials to attack the crucible vessel. By properly selecting the crucible and coil, and the power level and frequency applied to the coil, it is possible to urge the molten materials away from the crucible vessel, in effect levitating the molten material.

Casting

Since some amount of time will necessarily elapse between material melting and injection, the material can be melted at a temperature that is high enough to ensure that the material remains at least substantially molten until it is injected, but is low enough to ensure that solidification occurs at desired cooling rate to form the final products such as BMG articles. In the case that a relative low temperature is used, transfer and injection of molten materials must be rapid enough prior to metal solidification.

For example, the cooling rate of the molten metal alloys to form a BMG article has to such that the time-temperature profile during cooling does not traverse through the nose-shaped region bounding the crystallized region in the TTT diagram of FIG. 2. Also, amorphous metals/alloys can be produced with cooling rates high (rapid) enough, e.g., higher than the critical cooling rate, to allow formation of amorphous materials, and low enough to allow formation of amorphous structures in thick layers—e.g., for bulk metallic glasses (BMG). In one example, Zr-based alloy systems including different elements, may have lower critical cooling rates of less than 103° C./sec, and thus they have much larger critical casting thicknesses than their counterparts. In embodiments, in order to achieve a cooling rate higher than the critical cooling rate, heat has to be extracted from the sample.

BMG Articles

BMG articles may be formed by using the disclosed casting systems and their methods including use of, e.g., a die-casting or other applicable casting machine. The BMG articles may have various three dimensional (3D) structures as desired, including, but not limited to, flaps, teeth, deployable teeth, deployable spikes, flexible spikes, shaped teeth, flexible teeth, anchors, fins, insertable or expandable fins, anchors, screws, ridges, serrations, plates, rods, ingots, discs, balls and/or other similar structures.

Metal alloys used for forming BMG articles may be Zr-based, Fe-based, Ti-based, Pt-based, Pd-based, gold-based, silver-based, copper-based, Ni-based, Al-based, Mo-based, Co-based alloys, and the like, and combinations thereof. Metal alloys used for forming BMG articles may include those listed in Table 1 and Table 2.

For example, Zr-based alloys may include any alloys (e.g., BMG alloys or bulk-solidifying amorphous alloys) that contain Zr. In addition to containing Zr, the Zr-based alloys may further include one or more elements selected from, Hf, Ti, Cu, Ni, Pt, Pd, Fe, Mg, Au, La, Ag, Al, Mo, Nb, Be, or any combinations of these elements, e.g., in its chemical formula or chemical composition. The elements can be present at different weight or volume percentages. In embodiments, the Zr-based alloys may be free of any of the aforementioned elements to suit a particular purpose. For example, in some embodiments, the Zr-based metal alloys, or the composition including the Zr-based metal alloys, may be substantially free of nickel, aluminum, titanium, beryllium, and/or combinations thereof. In one embodiment, the Zr-based metal alloy, or the composition including the Zr-based metal alloy may be completely free of nickel, aluminum, titanium, beryllium, and/or combinations thereof.

Systems and Methods

Figure 4:
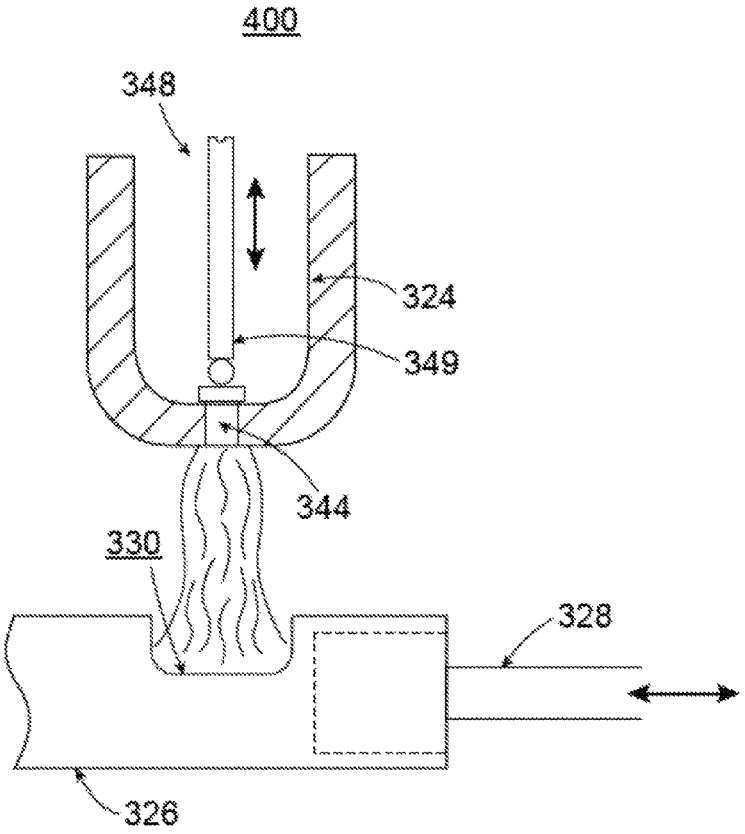
FIG. 4 depicts an exemplary melt vessel or alloy vessel in accordance with various embodiments of the present teachings.
Figure 5:
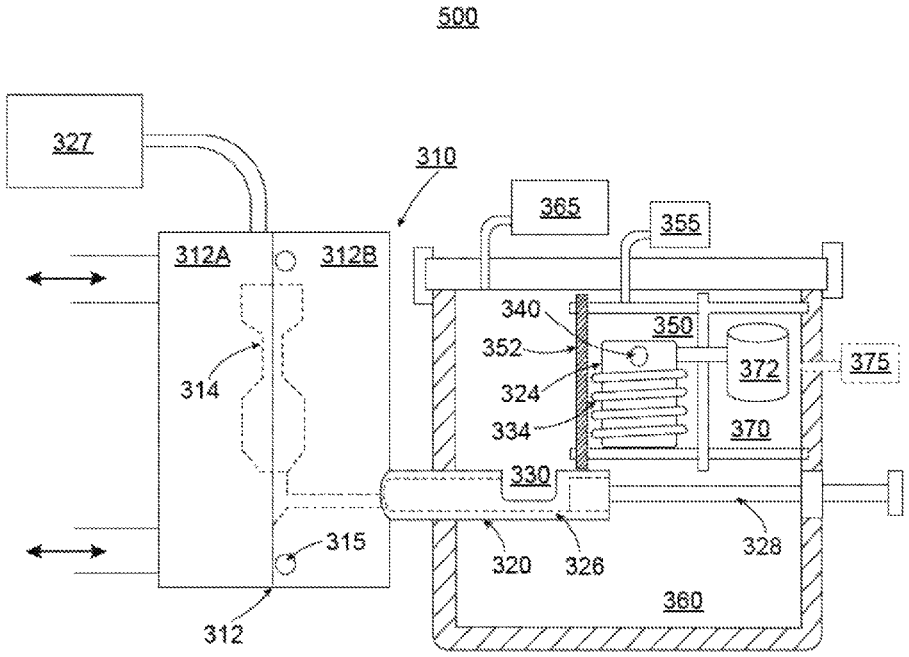
FIG. 5 depicts another exemplary casting system in accordance with various embodiments of the present teachings.

Referring now to the drawings wherein like reference numerals refer to similar or identical parts throughout the several views. Note that devices, systems, and methods depicted in FIGS. 3-5 are merely examples and described primary using a die-casting machine as an example, although one of ordinary skill in the art would appreciate that any kind of casting machines and casting methods can be used and incorporated in the present disclosure.

Figure 3:
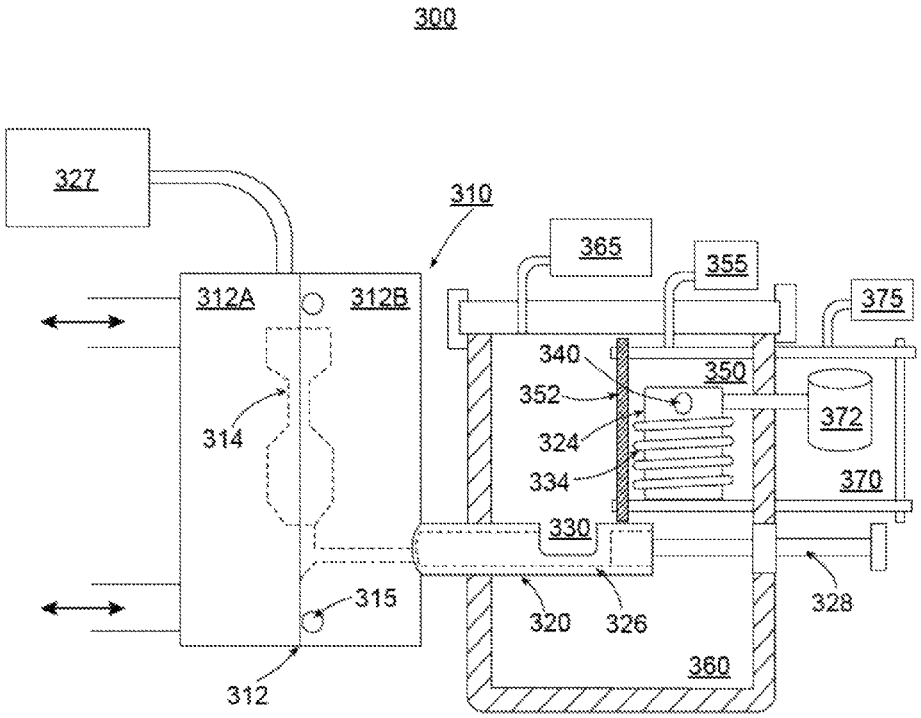
FIG. 3 depicts an exemplary casting system in accordance with various embodiments of the present teachings.

FIG. 3 depicts an exemplary system 300 for casting articles in accordance with various embodiments of the present teachings.

In FIG. 3, the casting system 300 may include a casting machine 310, a first chamber 350 including a vessel 324, a transfer zone chamber 360 including at least a portion of the casting machine 310 and the first chamber 350 such that materials, e.g., molten materials, in the vessel 324 of the first chamber 350 can be transferred, in the transfer zone chamber 360, into the a portion of the casting machine 310, e.g., an injection device 320 of the casting machine 310. for a casting process. In embodiments, the vessel 324 containing molten materials in the first chamber 350 may be connected with a second chamber 370. The second chamber 370 may include a second vessel 372 to provide or pre-treat materials that are subsequently transferred to the vessel 324 in the first chamber 350.

In one embodiment, the second chamber 370 may be a charge chamber configured to store one or more charges of a metal alloy, which can then be transferred into the vessel 324 of the first chamber 350 for melting. For example, feedstock of metal alloys may be provided and transferred from the second chamber 370 into the vessel 324. The vessel 324 may be used as a melt vessel for melting metal alloys to form molten materials.

In another embodiment, the second chamber 370 can be a charge chamber configured to preheat one or more charges of a metal alloy to prepare the metal alloy for a complete melting in the vessel 324 within the first chamber 350. The preheated charges of the metal alloy can be maintained non-molten in the second chamber 370 and then transferred to the first chamber 350 for melting. For example, feedstock of metal alloys may be pretreated, although non-molten, in the second chamber 370 and then transferred to the first chamber 350.

In yet another embodiment, the second chamber 370 may be a storage chamber for containing alloy constituents and then provide them into the first chamber 350 for a further process of metal alloying, followed by melting of the alloyed metal. Accordingly, the vessel 324 may be used as an alloying vessel for alloying materials including at least one metal. The alloyed metal may then be melted to form molten materials in the first chamber 350. The alloying can be done under vacuum or under inert gases, particularly of ingredient for making a BMG alloy.

The vessel 324 and/or 372 may be the same or different. Depending on the melting methods used herein, the vessel 324 can be a crucible within which the molten materials are melted and contained. There is heating means, such as an induction coil 334, surrounding the vessel 324 within the first chamber 350, which is decoupled with the transfer zone chamber 360. The heating means can also include a resistive heating coil, or any possible heating means as known in the art.

In some embodiments, the vessel 324 can be a pouring device comprised of a tilt pour system as shown in FIG. 3. The tilt pour system may include the vessel 324 and a pivot element 340 about which the vessel can tilt. The tilt pour system may also include a mechanism (not shown), such as a handle extending from the first chamber 350 for tilting the vessel 324 about the pivot element 340 such that the melted material pours into the injection device 320 about the pivot element 340 through the port 330. In this case, the induction coil 334 surrounding the vessel 324 can be designed to tilt with the vessel 324 for efficient heating. The first chamber 350 may have a gate valve 352 for facilitating transfer of materials from the first chamber 350 to the transfer zone chamber 360. For example, the gate valve 352 may be configured to open the first chamber 350 to allow the molten metal to enter the at least one portion of the casting machine when the casting machine is sufficiently evacuated. The gate valve 352 may also facilitate to control the internal chamber environment of the first chamber 350 and/or the transfer zone chamber 360.

In other embodiments, as shown in FIG. 4, the vessel 324 can be a pouring device comprised of a bottom pour system. The vessel 324 can have a pour hole 344 disposed above the port 330 of the transfer sleeve 326 and a lift plunger mechanism 348 for selectively opening the pour hole 344 such that when the pour hole 344 is opened, molten materials within the vessel 324 pours into the port 330 of the transfer sleeve 326. The lift plunger mechanism 348 may include a plunger member 349. Various other pouring mechanism as known in the art may be used without limitation.

Molten materials can be transferred from the first chamber 350 into the injection device 320 of the casting machine 310. In embodiments, two or more vessels 324 can be configured in the first chamber 350 for containing same or different molten materials therein and then sequentially or simultaneously pouring the molten materials into the injection device 320. Such pouring or transferring processes may be conducted in the transfer zone chamber 360, within which the first chamber 350 can be isolated from the injection device 320. The transfer zone chamber 360 can cover at least a portion or the entire chamber of the first chamber 350 and at least a portion of an exemplary casting machine 310.

The casting machine 310 may be, e.g., a die casting machine, including a die 312 having a die cavity 314. The casting machine 310 can include the injection device 320 for receiving and introducing, e.g., molten materials, from the first chamber 350 into the die cavity 314. The injection device 320 can be in fluidic communication with the die cavity 314 and can be at least partially disposed within the transfer zone chamber 360. The die 312 may be comprised of mating die halves 312*a* and 312*b*, which are sealed together with, e.g., an o-ring 315, as is well known in the art of die casting. The injection device 320 can include a transfer sleeve 326 such as a shot sleeve. The transfer sleeve 326 may be a cold transfer sleeve. The transfer sleeve 326 may have the port 330 through which molten material may be transferred, e.g., poured into the transfer sleeve 326 from the vessel 324. Molten materials transferred in the injection device 320 can be forced into the die cavity 314 with a ram 328 which can be, for example, hydraulic or pneumatic, or with gas pressure from gas providing means.

It should be appreciated that the die cavity 314 and transfer zone chamber 360 can be configured in relationship to each other in a variety of ways. In one embodiment, the transfer zone chamber 360 and die 312 can be disposed in a horizontal relationship. In another embodiment, the die cavity 314 and the transfer zone chamber 360 can be disposed in a vertical relationship with the die cavity 314 above or below the transfer zone chamber 360.

As shown in FIG. 3, each of the first chamber 350, the transfer zone chamber 360, and/or the second chamber 370 may be controlled separately. The first chamber 350 can be independently controlled, e.g., by a source device 355; the transfer zone chamber 360 can be independently controlled, e.g., by a source device 365; and the second chamber 370 can be independently controlled, e.g., by a source device 375. The source devices 355/365/375 may independently provide desired chamber environments for specific applications within corresponding chambers. For example, the first chamber 350 can be functionally separated from or decoupled with the casting machine 310 to have a chamber environment same or different than the chamber environment of the transfer zone chamber 360.

The chamber environment of chambers 350, 360, 370 may be controlled to include a vacuum environment wherein the source devices provide vacuum source, an inert environment wherein the source devices may purge inert gases (e.g., Ar, $N_2$, etc.) into the desired chambers, or an open environment wherein the corresponding chambers are open to the surrounding environments, e.g., under normal temperature and pressure as defined in the art, etc.

The transfer zone chamber 360 can be connected to the source device 365 for controlling a transfer zone chamber environment within the transfer zone chamber 360, for example, for creating a vacuum or purging inert gases in the transfer zone chamber 360. In embodiments, the source device 365 can be a vacuum device connected to the transfer zone chamber 360 so that the die cavity 314 can be evacuated from the transfer zone chamber 360 through the injection device 320. Alternatively, the die cavity 314 can be evacuated with a separate evacuating means 327.

In embodiments, the first chamber 350 (e.g., used as a melt chamber and/or an alloy chamber) may be independently maintained in an inert gas environment, while the injection device 320 may be in a vacuum environment or the casting machine may be opened to the surrounding environment.

The first and second chambers can be controlled to have the same or different chamber environments for various functions. For example, they can both have a vacuum (or an inert) environment. Alternatively, one of them can have a vacuum environment and the other can have an inert environment. In embodiments, the first and the second chambers may be configured similar, i.e., having a vessel therein for containing materials.

During operation, in one embodiment, the vessel 324 may be a cold crucible, such as a skull melter. In embodiments, use of skull melter may provide various benefits, such as avoiding or reducing contamination of the molten materials due to the skull, which self replenishes, formed between the molten material and the cold crucible. Molten materials are desirable to be melted in the vessel 324 of the first chamber 350 under, e.g., argon, to specifically prevent possible reactions of the reactive molten materials. By using the disclosed casting systems having chambers individually and/or independently controllable, molten materials can be melted in argon and poured from, e.g., the cold crucible, in a positive pressure and casted into an evacuated mold. In embodiments, when transferring or pouring the molten materials from an inert gas environment into a vacuum environment, the vacuum in the transfer zone chamber will be reduced but will have a sufficient amount for injection and molding of the molten material, e.g., to prevent porosity and other defects in the final products.

In one embodiment, the second chamber 370 can be configured within the first chamber 350 as shown in FIG. 5, wherein the second chamber 370 may have a separate control of the chamber environment, e.g., by the source device 375. In embodiments, the vessel 324 (e.g., for melting metal alloys and/or for alloying metals) and the vessel 372 may be configured in one chamber having the same chamber environment.

In embodiments, the transfer zone chamber 360 including at least a portion of the injection device 320 may further contain (not illustrated) the mold cavity 314, and/or the entire casting machine 310.

In this manner, because the first chamber 350 having the a melt vessel and/or an alloy vessel are decoupled from the transfer zone chamber 360, following release of the molten alloy in the transfer zone chamber 360 from the first chamber 350 into the transfer sleeve 326, the first chamber 350 can be free for removal from the transfer zone environment containing at least one portion of the molding machine 310 and can be used for alloying and/or melting the next successive materials. Meanwhile, on the other hand, moulds or cast material produced in the mold cavity of the casting machine 310 may be solidified to form final products.

In embodiments, various different types of final products or articles may be produced in separate parts of the same casting machine. Accordingly, the casting machine can operate on a set cycle for a wide variety of different products by independently control and remove the first chamber, which is maintained under vacuum or inert gases for the next process. Cycle time can then be reduced.

In embodiments, a plurality of casting machines can be configured in one casting system, with articles being produced in different machines and each individual final article for one type of cast product in one production cycle. When a different type of product is to be cast, the operating parameters of the casting line may change, to suit the new manufacturing and casting requirements of the final article, such as the new shape and the change in volume of molten material for producing the new article. Because the first chamber 350 (e.g., as a melt chamber and/or a alloy chamber) can be separately processed from the transfer zone chamber 360 and/or the casting machine 310, the operating parameters can be flexibly changed. In addition, each of the plurality of casting machines can be selected as desired depending on requirements of the casting and final products. For example, individual final products produced from the plurality of casting machines may require different amorphous levels, e.g., some of them require at least 50% of its volume being amorphous, such as at least 60%, such as at least 80%, such as at least 90%, such as at least 95%, such as at least 99%, being amorphous. For forming articles having low requirements of amorphous level, cost may be reduced by selecting to use one or more casting machines that have low cost mold with relatively poor sealing in the plurality of casting machines.

While the invention is described and illustrated here in the context of a limited number of embodiments, the invention may be embodied in many forms without departing from the spirit of the essential characteristics of the invention. The illustrated and described embodiments, including what is described in the abstract of the disclosure, are therefore to be considered in all respects as illustrative and not restrictive. The scope of the invention is indicated by the appended claims rather than by the foregoing description, and all changes that come within the meaning and range of equivalency of the claims are intended to be embraced therein.

What is claimed is:

1. A casting method comprising, in a system comprising a transfer zone chamber that contains at least a portion of a melt chamber and at least a portion of a casting machine:

introducing a material into a vessel in the melt chamber;

adjusting an environment of the melt chamber;

melting the material in the vessel; and while substantially independently maintaining the environment of the melt chamber, transferring the molten material, in the transfer zone chamber, from the melt chamber into the casting machine.

2. The method of claim 1, further comprising adjusting an environment of the transfer zone chamber prior to transferring the molten material.

3. The method of claim 1, further comprising substantially independently maintaining an environment of the transfer zone while transferring the molten material.

4. The method of claim 1, wherein the environment of the melt chamber is an inert environment, the method further comprising substantially independently maintaining an environment of the transfer zone chamber under vacuum.

5. The method of claim 1, wherein:

the operation of substantially independently maintaining the environment of the melt chamber occurs while the transfer zone chamber is open to a surrounding environment; and the environment of the melt chamber is an inert environment or a vacuum.

6. The method of claim 1, further comprising controlling the transfer zone chamber under a vacuum higher than a vacuum in the melt chamber.

7. The method of claim 1, further comprising casting the molten material into a BMG part, wherein the BMG part is formed of a Zr-based, Fe-based, Ti-based, Pt-based, Pd-based, gold-based, silver-based, copper-based, Ni-based, Al-based, Mo-based, Co-based alloy, or combinations thereof.

8. A casting method comprising, in a system comprising a transfer zone chamber that contains at least a portion of a first chamber and at least a portion of a casting machine, the first chamber connected to a second chamber:

controlling an environment of the first chamber independently from an environment of the transfer zone chamber;

transferring a feedstock of a metal alloy from the second chamber into a vessel in the first chamber;

melting the feedstock in the vessel; and while substantially independently maintaining the environment of the first chamber, transferring the molten feedstock, in the transfer zone environment, from the first chamber into the casting machine.

9. The method of claim 8, wherein melting the feedstock comprises melting the feedstock using induction skull remelting or melting, vacuum induction melting (VIM), electron beam melting, resistance melting, or plasma arc melting.

10. The method of claim 8, wherein melting the feedstock comprises melting the feedstock under an inert gas environment.

11. The method of claim 8, further comprising, prior to transferring the feedstock from the second chamber into the vessel in the first chamber, preheating the feedstock in the second chamber.

12. The method of claim 11, wherein the operation of preheating the feedstock in the second chamber comprises preheating the feedstock to a temperature below a melting temperature of the feedstock.

13. The method of claim 8, further comprising controlling an environment of the second chamber independently from the environment of the first chamber and the environment of the transfer zone chamber.

14. The method of claim 8, wherein the operation of controlling the environment of the first chamber comprises controlling parameters consisting essentially of:

a pressure within the first chamber; and a type of gas present in the first chamber.

15. The method of claim 8, further comprising storing, in the second chamber, a plurality of charges of the feedstock.

16. A casting method comprising:

controlling an environment of a transfer zone chamber that contains at least part of a melt chamber;

controlling an environment of a melt chamber substantially independently from the transfer zone chamber, the melt chamber containing a vessel and being in communication with the transfer zone chamber via an opening;

introducing a material into the vessel;

melting the material in the vessel;

transferring the molten material from the melt chamber into a portion of a casting machine disposed within the transfer zone chamber.

17. The method of claim 16, further comprising, prior to transferring the molten material, opening a gate separating the transfer zone chamber from the melt chamber.

18. The method of claim 17, further comprising, while the gate is open:

maintaining an at least partial vacuum in the transfer zone chamber; and maintaining an at least partial inert gas environment in the melt chamber.

19. The method of claim 16, further comprising preheating the material, to below a melting temperature of the material, in a preheat chamber that is in communication with the melt chamber.

20. The method of claim 19, further comprising controlling an environment of the preheat chamber substantially independently from the transfer zone chamber and the melt chamber.

* * * * *